US008181620B2

(12) United States Patent
Rolland et al.

(10) Patent No.: US 8,181,620 B2
(45) Date of Patent: May 22, 2012

(54) MODULAR INTAKE MANIFOLD

(75) Inventors: Francis V. Rolland, Rochester Hills, MI (US); Iliya Goldin, Rochester, MI (US); Eric F. Grimminger, Rochester Hills, MI (US); Allen G. Crowley, Rubicon Township, MI (US); Thomas E. Rossman, Rochester Hills, MI (US); Tony A. Price, Lake Orion, MI (US)

(73) Assignee: Mark IV Systems Moteurs USA, Inc., Rochester Hills, MI (US)

( * ) Notice: Subject to any disclaimer, the term of this patent is extended or adjusted under 35 U.S.C. 154(b) by 848 days.

(21) Appl. No.: 12/189,393

(22) Filed: Aug. 11, 2008

(65) Prior Publication Data

US 2010/0031913 A1 Feb. 11, 2010

(51) Int. Cl.
*F02M 35/10* (2006.01)

(52) U.S. Cl. ..... 123/184.21

(58) Field of Classification Search ..... 123/184.34, 123/184.47, 184.42, 184.53, 184.35; *F02M 35/10*
See application file for complete search history.

(56) References Cited

U.S. PATENT DOCUMENTS

| | | | | |
|---|---|---|---|---|
| 4,111,163 | A * | 9/1978 | Ederer et al. | 123/184.42 |
| 5,636,605 | A | 6/1997 | Nomizo et al. | |
| 5,653,201 | A * | 8/1997 | Hosoya | 123/184.34 |
| 5,896,838 | A | 4/1999 | Pontopiddan et al. | |
| 6,199,530 | B1 | 3/2001 | Brassell et al. | |
| 6,530,352 | B2 | 3/2003 | Corduan et al. | |
| 6,581,561 | B1 | 6/2003 | Brodesser et al. | |
| 2004/0118362 | A1 * | 6/2004 | Inayama | 123/41.49 |
| 2009/0272589 | A1 * | 11/2009 | Ballard | 180/68.3 |

* cited by examiner

*Primary Examiner* — Michael Cuff
*Assistant Examiner* — Keith Coleman
(74) *Attorney, Agent, or Firm* — Thompson Hine L.L.P.

(57) ABSTRACT

Disclosed herein is an intake manifold assembly that comprises a first outer covering, a second outer covering connected to the first outer covering that together define a chamber having an intake port, and a flow channel insert. The second outer covering has an outlet port positioned within its interior surface and the flow channel insert is nestingly connected to the outlet port with the rest of the flow channel insert received within the chamber. The flow channel insert being a single piece that defines a channel having a first end and a second end.

28 Claims, 3 Drawing Sheets

MODULAR INTAKE MANIFOLD

BACKGROUND

The present application relates generally to an intake manifold.

Internal combustion engines have utilized air intake manifolds with progressively lighter materials to improve weight efficiency for acceleration performance and fuel economy. The progression to lighter materials has included cast iron, aluminum, and more recently injection-molded thermoplastics.

Differing manufacturing and assembly methods are in widespread use, from lost core injection molding to welded assemblies of multiple injection-molded pieces. However, injection molding requires customization of each injection-molding tool to meet the requirements of the particular application, particularly to the type of internal combustion engine, e.g., 4 cylinders or 6 cylinders of inline or V architecture, etc. Each piece must be evaluated and may need adjustments to customize the flow, power loss, and vibration an/or acoustical optimization. These adjustments add cost and time to the development cycle and the total engine programs.

An improved modular construction for an intake manifold is needed that reduces customization of each piece.

SUMMARY

Disclosed herein is a modular intake manifold assembly that comprises a first outer covering, a second outer covering and a flow channel insert. The first and second outer coverings are connected together to define a chamber therebetween having an intake port. The flow channel insert defines as a single piece a channel having a first end and a second end. The second outer covering includes an outlet port positioned within the interior surface thereof and the flow channel insert's second end nestingly connected to the outlet port with the rest of the flow channel insert being received within the chamber with the first end thereof defining an air inlet open within the chamber.

A modular intake manifold is one made of multiple parts that fit together to form the intake manifold. Disclosed herein is an intake manifold that includes a novel flow channel insert that is readily manufacturable and already optimized for insertion into an intake manifold. A plurality of the flow channels may be made in advance and held ready for assembly into an intake manifold for any internal combustion engine architecture. The outer coverings, disclosed herein, that form the shell of the intake manifold are scalable to different sizes to conform to the number of cylinders of the particular internal combustion engine selected to have the intake manifold. In particularly the second outer covering forming the base of the intake manifold is scalable to have the necessary number of outlet ports to match the number of cylinder of the engine. The outlet ports should also be positioned within the base for alignment with a lower intake manifold and/or ultimately the cylinders of the engine. Once the base is scaled to include the necessary number of outlet ports, a pre-made flow channel insert may be connected to each outlet port. The modular intake manifold and the scalability of the coverings reduces adjustments to customize flow, power loss, and vibration/acoustical optimization that were often necessary in the past when making an intake manifold for different internal combustion engine architectures.

In another aspect, the disclosure includes a method for assembling a modular air intake manifold. The method includes providing a first outer covering, providing a second outer covering having a perimeter and an interior surface with an outlet port positioned therein, providing a flow channel insert having a first end and a second end and defining as a single piece a channel therein, where the first end defines an air inlet and the second end is connectable to the outlet port. The method also includes connecting the second end of the flow channel insert and the outlet port with a nesting connection and positioning the first outer covering relative to the second outer covering to house the flow channel insert within a chamber defined therebetween such that the first end of the flow channel insert is open within the chamber.

DETAILED DESCRIPTION

Figure 1:
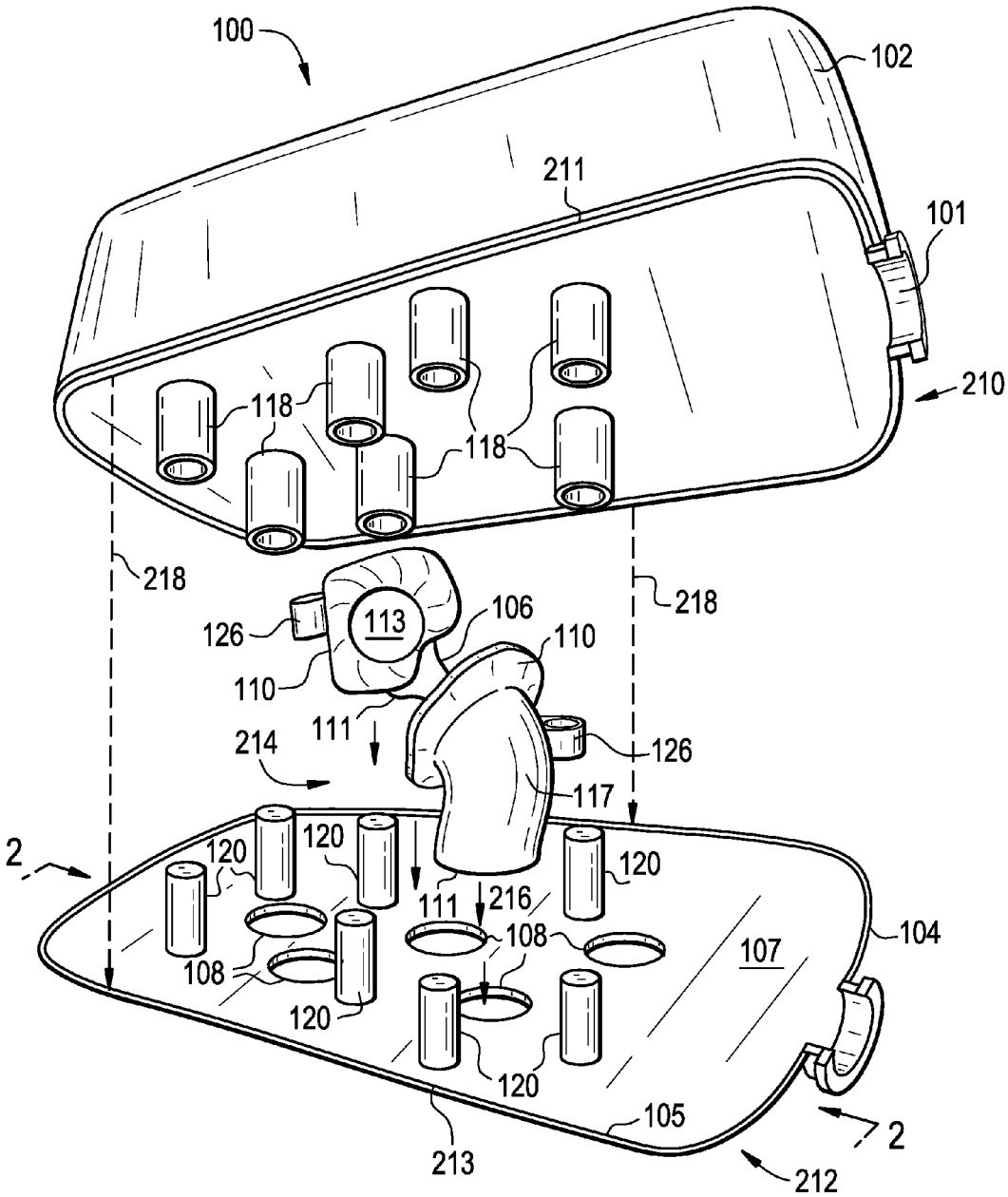
FIG. 1 is an exploded partial side view of one embodiment of an intake manifold assembly.

In one embodiment as seen in FIG. 1, an intake manifold assembly, generally represented as numeral 100, includes a first outer covering 102, a second outer covering 104, and a flow channel insert 106. The second outer covering 104 includes one or more outlet ports 108. The first and the second outer coverings 102, 104 may be connected together such that a chamber 112 (shown in FIGS. 2A and 2B) is defined therebetween. The flow channel insert 106 may be received within the chamber 112 defined between the first and the second outer coverings 102, 104. The flow channel insert 106 is a single piece defining a channel therein and has a first end 110 and a second end 111. The first end 110 may define an air inlet 113 that is open within the chamber 112. The second end 111 may be connected to the outlet port 108. The connection between the second end 111 and the outlet port 108 may be a nesting connection where one piece fits within at least a portion of the other. The intake manifold assembly 100 may also include an intake port 101. The intake port 101 may be formed within the first outer covering 102, within the second outer covering 104, or partially within each of the first and the second outer coverings 102, 104 such that when connected they form the intake port.

The first outer covering 102 may include a female protrusion 118 extending from its interior surface such that the female protrusion 118 is within the chamber 112. The first outer covering 102 may also include a flange 211. The flange 211 may be used to connect the first and the second outer coverings 102, 104 together. The first outer covering 102 maybe constructed to seal the intake manifold assembly or may include a gasket to seal the assembly when connected to the second outer covering 104. The first outer covering 102 may be sized as necessary to house any number of flow channel inserts 106 depending on the internal combustion engine with which the intake manifold assembly 100 is to be used. The first outer covering 102 may also include various surface features such as ribs, fixing points for attaching the first outer covering to the second outer covering or the assembled manifold to another engine component or the car, or concave and convex regions that may be alternating or undulating to enhance strength, acoustical optimization, and/or mountability of the intake manifold assembly 100.

Likewise the second outer covering 104 may be any shape and size necessary to house the appropriate number of flow channel inserts 106 and may include features to enhance strength, acoustical optimization, and/or mountability of the intake manifold assembly 100. The second outer covering 104 includes a perimeter 105 and an interior surface 107 and may include any number of outlet ports 108. The outlet ports 108 are positioned within the interior surface 107 and are connectable to a cylinder of an internal combustion engine. The outlet ports 108 may be connected to a lower intake manifold that is connected to the cylinders of the internal combustion engine to allow the flow channel insert 106 to be in fluid communication with the cylinders.

Figure 4:
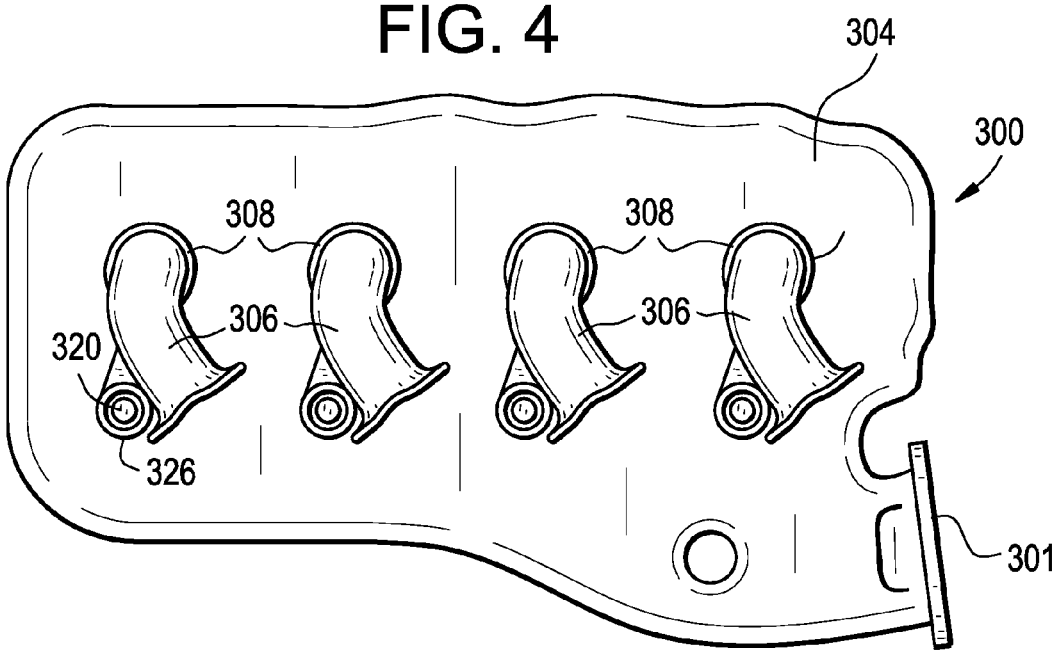
FIG. 4 is a top plan view of a second embodiment of an intake manifold assembly without the first outer covering.

The number of outlet ports 108 typically is equivalent to the number of cylinders of the engine or the number of ports or channels of the lower intake manifold. In other words, the second outer covering is scalable to a pre-selected number of outlet ports 108. The outlet ports 108 may be in any configuration within the second outer covering 104 that allows each outlet port 108 to be in fluid communication with a cylinder of the engine. For example, the second outer covering 104 may be configured for an in-line or a V engine architecture having any number of cylinders, for example a 4-cylinder, 5-cylinder, 6-cylinder, 8-cylinder, etc. An in-line 4 cylinder configuration is shown in FIG. 4. One skilled in the art will appreciate that there are other combinations of engine architecture and number of cylinders possible and that the assembly herein is applicable thereto.

The second outer covering 104 may include at least one post 120 extending from its interior surface such that the post 120 is within the chamber 112. An individual post 120 may be positioned adjacent to an outlet port 108. A post 120 in this position may act as a stabilizing post for holding a flow channel insert 106 in place within chamber 112. The post 120 may also be aligned for insertion into the female protrusion 118 of the first outer covering 102. When the post 120 is inserted in to the female protrusion 118 the connection may hold the first and the second outer coverings 102, 104 together. The second outer covering 104 may also include a flange 213. The flange 213 may be used to connect the second outer covering 104 to the first outer covering 102 via flange 211.

Figure 2A:
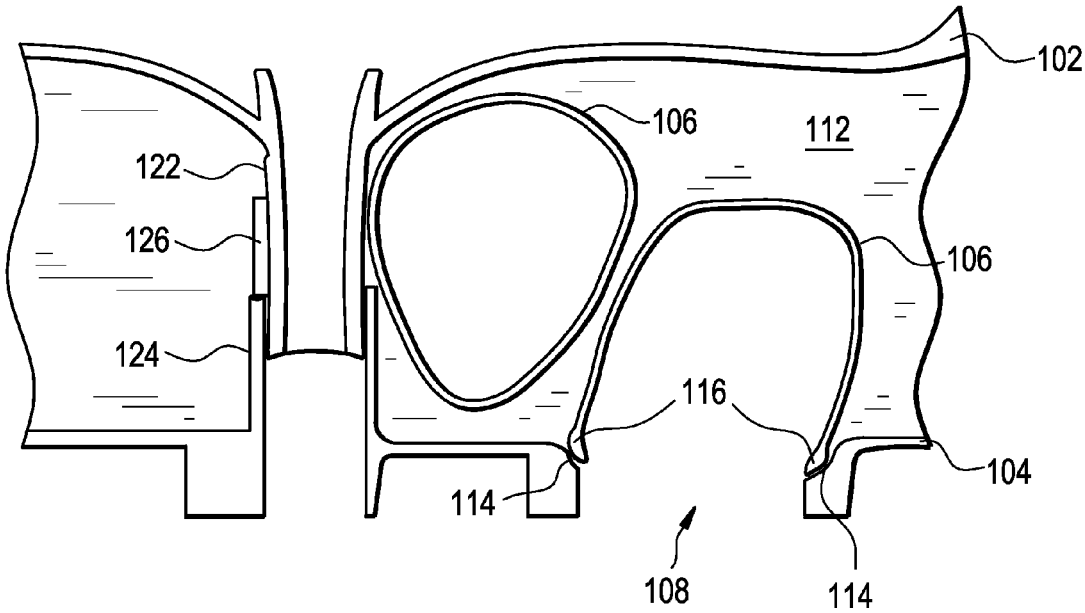
FIGS. 2A and 2B are partial cross-sectional views of an assembled intake manifold of the embodiment of FIG. 1.

In an alternative embodiment, as shown in FIG. 2A, the first outer covering 102 may include a post 122 and the second outer covering 104 may include a female protrusion 124. The post 122 may be positioned such that when the first outer covering 102 and second outer covering 104 are connected together the post 122 is adjacent to a flow channel insert 106 that is connected to an outlet port 108. The post 122 may act as a stabilizing post for holding the flow channel insert 106 in place within the chamber 112. The post 122 may also be positioned to align for insertion into the female protrusion 124 and when the post 122 is inserted therein the connection may hold the first and the second outer coverings 102, 104 together.

Figure 2B:
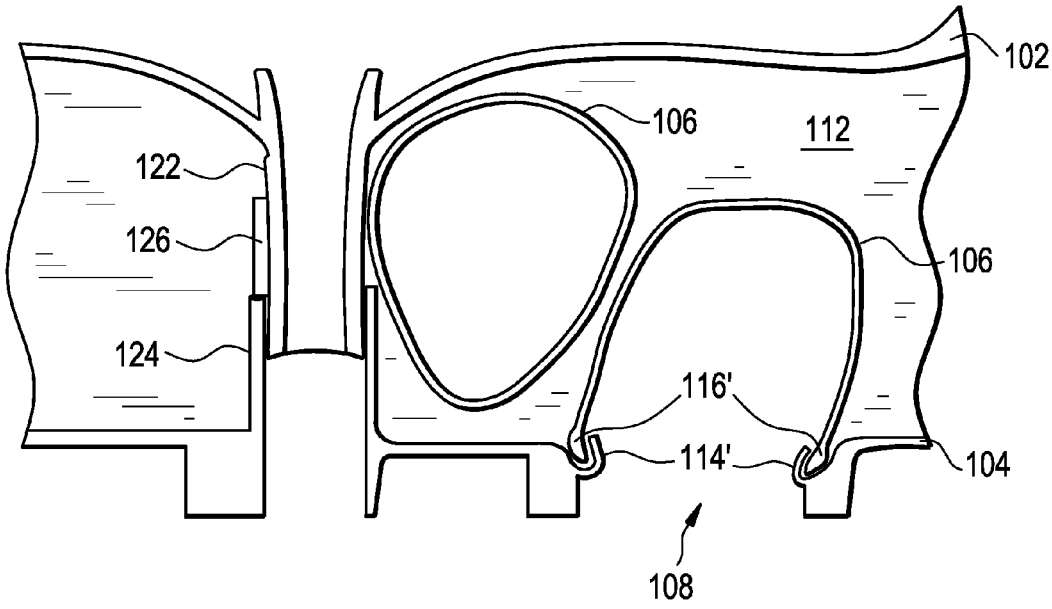
Figure 3:
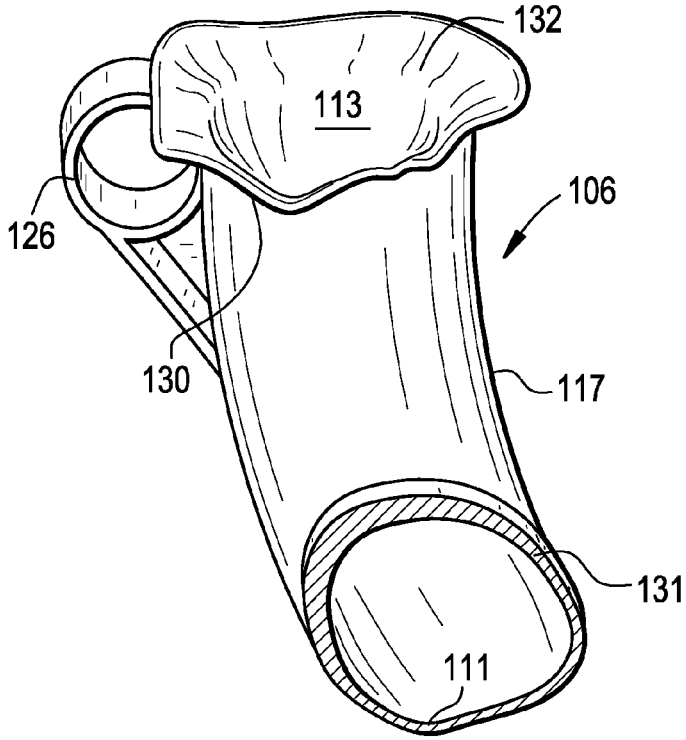
FIG. 3 is a side perspective view of a flow channel insert of the intake module assembly of FIG. 1.

Referring to FIGS. 1-3, the flow channel insert 106 may include a sleeve 126 connected to or formed integrally with the flow channel insert and extending from its exterior surface. The sleeve 126 may be positioned anywhere along the length of the flow channel insert 106 and in any orientation that allows the sleeve 126 to align with post 120 or 122. The sleeve 126 may be used to stabilize the flow channel insert 106 within the intake manifold assembly 100 by connecting the sleeve 126 to post 120 or 122 or to the female protrusion 118 or 124. The sleeve 126 may fit over or around the posts 120,122 or the female protrusions 118, 124. The sleeve 126 may be shrink fitted, press fitted, and/or spot welded to the post 120 or 122 to connect the flow channel insert thereto.

In an alternate embodiment, the flow channel insert 106 may be stabilized without the use of sleeve 126. Instead, the connection between the second end 111 of the flow channel insert 106 and the outlet port may be substantially rigid to stabilize the flow channel insert 106 within the chamber. Alternately, the first outer covering 102 may be pre-selected to fit generally snug against the upper most portion or feature of the flow channel insert 106 to stabilize the flow channel insert. Additionally, the first outer covering 102 may include a groove that receives a portion of the flange 130 (FIG. 3) of the flow channel insert 106 for stabilization thereof or the flow channel insert 106 may include stabilizing braces that attach to the first or the second outer coverings 102, 104.

An alternate view of the flow channel insert 106 is shown in FIG. 3. The first end 110 may define an inlet 113 and may include a flanged opening. The flange 130 may be outwardly flaring and the inlet may gradually widen as it opens toward the flange to direct increased fluid flow into the inlet 113. The flow channel insert 106 may include at least one bend 117 positioned anywhere along the length of the flow channel insert 106 which may be oriented in any direction to any degree as long as the passage of fluid through the flow channel insert 106 is not impeded. The bend 117 may be at least about 5° and in other embodiments at least about 45°. The degree and orientation of the bend 117 may be dependent upon the amount of space available within chamber 112 and the position of the intake port. Additionally, the bend 117 and overall shape of the flow channel insert 106 may be pre-selected to customize the flow of fluid into the engine, power loss, and vibration an/or acoustical optimization.

Still referring to FIG. 3, the second end 111 of the flow channel insert 106 is connectable to the outlet port 108 of the second outer covering 104. The connection may be a nested connection that is generally tight and generally non-leaking. The second end may include a contoured edge 131 having an inwardly tapered edge 116 as shown in FIG. 2A or an outwardly tapered edge 116' as shown in FIG. 2B. With respect to FIGS. 2A-2B, the outlet port 108 of the second outer covering 104 may include a rim 114 that has an oppositely tapered shape to that of the second end 111 of the flow channel insert for seating the second 111 against or within the rim 114 of the outlet port 108. The rim may be an outwardly tapered rim 114 as shown in FIG. 2A or an inwardly tapered rim 114' as seen in FIG. 2B. As shown in FIG. 2A, the edge 116 of the flow channel insert 106 may nest within the rim 114 of the outlet port 108. Alternately, as shown in FIG. 2B, the rim 114' may nest within the edge 116' of the flow channel insert 106. The second end 111 of the flow channel insert 106 and the rim 114 of the outlet port may be configured such that one or the other includes a notch and groove, a tab and slot, or a hook and detent assembly as an additional connecting feature that may provide an improved connection. The connection may also include press fitting, shrink fitting, and/or spot welding the second end 111 and the outlet port 108 together. The rim 114 of the outlet port 108 may have a pilot diameter configured to receive the second end 111 of the flow channel insert 106.

The first outer covering 102, the second outer covering 104, and/or the flow channel insert 106 may each be an injection molded plastic, generally a thermoplastic such as a polyamide. These components may be manufactured utilizing a standard pull injection molded thermoplastic process, which is known to one of skill in the art. The components may also be manufactured by other injection-molded techniques known in the art. As injection molded pieces the features, such as the posts, female protrusions, flanges, sleeve, etc. of the first outer covering 102, the second outer covering 104, and/or the flow channel insert may be formed integrally therewith. Alternately, certain features may be formed separately and then connected thereto.

The intake manifold assembly, described above, is modular. The modular intake manifold assembly is designed to have a flow channel insert that is already configured for optimal conditions. The flow channel insert is designed for connection with a pre-selectedly shaped outlet port. The modularity of the flow channel insert is an advantage because a plurality of flow channel inserts are readily duplicable since each may be molded form the same mold or multiples thereof. A further advantage is that the modular intake manifold is readily scalable to include any number of the flow channel inserts by changing the number of outlet ports and their configuration in the second outer covering. Typically in injection molding processes, each mold is custom to the application, which requires designing and making new molds for the intake manifold when the configuration of an engine changes, which can be costly and time consuming. Here, the flow channel insert eliminates redesigning and making new molds, at least for that part of the modular intake manifold assembly. Additionally, the shape and size of the outlet ports will be standardized to the flow channel insert, thus reducing the development cycle time. So only the size of the first and the second outer coverings and the number and layout of the outlet ports will need to be modified. As a result, the flow channel insert may be molded in various tool layouts and then incorporated into any configuration of outlet ports, which ultimately saves manufacturing time and costs.

The intake manifold assembly 100 or 300 of FIGS. 1-4 may be assembled according to the following method. The steps of the method are represented in FIG. 1 and include providing a first outer covering 210, providing a second outer covering 212 having a perimeter and an interior surface, and providing a flow channel insert 214 defining as a single piece a channel therein and having a first end and a second end. The second outer covering may include an outlet port within its interior surface. The first end of the flow channel insert may define an inlet and the second end may be connectable to the outlet port. The method includes connecting the second end and the outlet port 216 with a nesting connection. The second end may be connected to the outlet port as described above. The method also includes positioning the first outer covering relative to the second outer covering 218 to house the flow channel insert within a chamber defined between the first and the second outer coverings. The first end of the flow channel insert may be open with the chamber.

The method may also include connecting the first and second outer coverings to one another. The first and the second outer coverings may be connected by any means known to one of skill in the art, for example, welding, adhering with an adhesive, snap fitting, press fitting, shrink fitting, the post/female protrusion connection described above, and/or a fastener (bolt, screw, pop rivet, the like or combinations thereof). The connecting of the first and the second outer coverings may include mating flanges 211 and 213 together.

As described above, the flow channel insert may include a sleeve and the first outer covering may include a female protrusion (FIG. 1) or a post (FIG. 2A) and the second outer covering may include a post (FIG. 1) or a female protrusion (FIG. 2A). With the inclusion of these features the positioning of the first outer covering relative to the second outer covering 218 includes aligning the post 120 or 122 with the female protrusion 118 or 124, respectively, and inserting the post into the female protrusion. Additionally, the method may include stabilizing the flow channel insert within the chamber, as described above, including connecting the sleeve of the flow channel insert to the post or female protrusion of either of the outer coverings. The connecting of the sleeve to the post may include fitting or sliding the sleeve over the post or wrapping the sleeve around the post and then securing the sleeve in a closed position.

An alternate embodiment for the second outer covering 304 of an intake manifold assembly is shown in FIG. 4. The second outer covering 304 is configured in a 4-cylinder in-line configuration. The second outer covering 304 includes outlet ports 308 having individual flow channel inserts 306 connected thereto and is shown to include posts 320 and at least part of an intake port 301. The second outer covering 304 may not include posts 320 and/or form part of the intake port 301 in an alternate embodiment. The flow channel inserts 306 may include a sleeve 326 fitted around or over the posts 308. FIG. 4 is just one example of the possible configurations for the outlet ports 308 and flow channel inserts 306. Many variations are known to one of skill in the art.

Although only a few embodiments have been described in detail above, it will be appreciated by those of skill in the art that various modification and alterations can be made to the particular embodiments shown without materially departing from the teachings and advantages herein. Accordingly, it is to be understood that all such modifications and alterations are included within the spirit and scope of the following claims.

What is claimed is:

1. An intake manifold assembly comprising:

a first outer covering;

a second outer covering connected to said first outer covering, said first and second outer coverings defining therebetween a chamber having an intake port, said second outer covering having a perimeter and an interior surface, said interior surface including an outlet port positioned therein; and a flow channel insert defining as a single piece a channel therein and having a first end and a second end, said flow channel insert received within said chamber with said first end defining an air inlet open within said chamber, and said second end nestingly connected with said outlet port to form a connection therebetween;

wherein at least one of the first outer covering or the second outer covering includes a post that extends into the chamber, the post being positioned adjacent to the outlet port;

wherein said flow channel insert has an exterior surface relative to the channel therein and includes a sleeve extending from the exterior surface, wherein the sleeve has an open first end, an open second end, and is positioned along the length of the flow channel insert more proximate the first end thereof with the sleeve oriented relative to the flow channel insert for alignment with the post, wherein the sleeve is seated on the post.

2. The assembly of claim 1 wherein said connection between said second end and said outlet port includes at least one of a press fit, a shrink fit, and a spot weld.

3. The assembly of claim 1 wherein said second end includes an edge that is tapered and said outlet port includes a rim having an oppositely tapered shape to that of said edge for seating said second end against said outlet port.

4. The assembly of claim 3 wherein said edge of said second end is outwardly tapered.

5. The assembly of claim 3 wherein said edge of said second end is inwardly tapered.

6. The assembly of claim 1 wherein at least one of said first outer covering, said second outer covering and said flow channel insert is an injection-molded plastic.

7. The assembly of claim 1 wherein said flow channel insert has at least one bend in the channel along the length thereof thereby defining an elbow in the channel.

8. The assembly of claim 1 wherein said first end of said flow channel insert includes a flanged opening that directs fluid flow into said air inlet.

9. The assembly of claim 1 wherein said first outer covering includes the post and said second outer covering further comprises a female protrusion extending into said chamber, wherein said post is received in said female protrusion as a generally secure connection that holds the first and second outer coverings together.

10. The assembly of claim 1, wherein said second outer covering includes the post and said first outer covering further comprises a female protrusion extending into said chamber, wherein said post is received in said female protrusion as a generally secure connection that holds the first and second outer coverings together.

11. The assembly of claim 1 wherein said second outer covering is scalable to a pre-selected number of outlet ports configured to align with said cylinders of an internal combustion engine of a preselected architecture and each outlet port has a separate flow channel insert connected thereto.

12. The assembly of claim 11 wherein each of said separate flow channel inserts are injection molded plastic and are duplicates of one another.

13. A method for assembling an air intake manifold comprising:

providing a first outer covering;

providing a second outer covering having a perimeter and an interior surface, said interior surface including an outlet port positioned therein;

wherein at least one of the first outer covering or the second outer covering includes a post that extends into the chamber, the post being positioned adjacent to the outlet port;

providing a flow channel insert, said flow channel insert defining as a single piece a channel therein with an exterior surface relative to the channel and having a first end and a second end;

wherein the flow channel insert includes a sleeve having an open first end and an open second end that is extending from the exterior surface thereof with the sleeve oriented relative to the flow channel insert for alignment with the post;

nestingly connecting said second end of said flow channel insert to said outlet port while seating the sleeve of the flow channel insert onto the post;

positioning said first outer covering relative to said second outer covering to house said flow channel insert within a chamber defined between said first and said second outer coverings, wherein said first end of said flow channel insert is open within said chamber.

14. The method of claim 13 further comprising connecting said first outer covering to said second outer covering.

15. The method of claim 14 wherein connecting said first and said second outer coverings includes at least one of welding, adhering, snap fitting, shrink fitting, and press fitting said first and said second outer coverings together.

16. The method of claim 13 wherein said second outer covering includes the post and said first outer covering includes a female protrusion extending into said chamber, wherein positioning said first outer covering includes aligning said post and said female protrusion and inserting said post into said female protrusion.

17. The method of claim 13 wherein said first outer covering includes the post and said second outer covering includes a female protrusion extending into said chamber, wherein positioning said first outer covering includes aligning said post and said female protrusion and inserting said post into said female protrusion.

18. The method of claim 13 wherein said step of nestingly connecting further includes at least one of press fitting, shrink fitting, and spot welding to hold said second end and said outlet port together.

19. The method of claim 13 wherein at least one of said first outer covering, said second outer covering, and said flow channel insert is an injection-molded plastic.

20. The method of claim 19 wherein said second outer covering is scalable to a pre-selected number of outlet ports configured for the number of cylinders of an internal combustion engine of a preselected architecture, wherein each outlet port has a separate flow channel insert connected thereto.

21. The method of claim 20 wherein said separate flow channel inserts are injection-molded plastic and each of said separate flow channel inserts are duplicates of one another.

22. The method of claim 13 wherein said first outer covering, said second outer covering and said flow channel insert are modular.

23. The assembly of claim 13 wherein the sleeve is positioned along the length of the flow channel insert such that the sleeve is more proximate the first end of the flow channel insert.

24. An intake manifold assembly comprising:

a first outer covering;

a second outer covering connected to said first outer covering, said first and second outer coverings defining therebetween a chamber having an intake port, said second outer covering having a perimeter and an interior surface, said interior surface including an outlet port positioned therein, the outlet port having a mouth defined by a rim that is recessed axially into the interior surface of the second outer covering, the rim being generally U-shaped when viewed in cross-section; and a flow channel insert defining as a single piece a channel therein and having a first end and a second end, said flow channel insert received within said chamber with said first end defining an air inlet open within said chamber, and said second end defining a contoured edge that nests in the rim of the outlet port to form a connection therebetween.

25. The assembly of claim 24 wherein the rim of the outlet port is contoured oppositely of the contoured edge of the flow channel insert to provide a press fit or a shrink fit connection.

26. The assembly of claim 24 wherein said second outer covering is scalable to a pre-selected number of outlet ports configured to align with cylinders of an internal combustion engine of a preselected architecture and each outlet port has a separate flow channel insert connected thereto.

27. The assembly of claim 26 wherein each of said separate flow channel inserts are injection molded duplicates of one another.

28. The assembly of claim 24 wherein said flow channel insert has at least one bend in the channel along the length thereof thereby defining an elbow in the channel.

* * * * *